US006301895B1

(12) United States Patent
Kallina et al.

(10) Patent No.: US 6,301,895 B1
(45) Date of Patent: Oct. 16, 2001

(54) METHOD FOR CLOSED-LOOP OUTPUT CONTROL OF A STEAM POWER PLANT, AND STEAM POWER PLANT

(75) Inventors: Günter Kallina, Waldbronn; Rudolf Kral; Eberhard Wittchow, both of Erlangen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/568,360

(22) Filed: May 10, 2000

Related U.S. Application Data

(63) Continuation of application No. PCT/DE98/03153, filed on Oct. 28, 1998.

(30) Foreign Application Priority Data

Nov. 10, 1997 (DE) ..... 197 49 452

(51) Int. Cl.[7] ..... F01K 7/34; F01K 13/02
(52) U.S. Cl. ..... 60/653; 60/646; 60/657
(58) Field of Search ..... 60/646, 653, 657

(56) References Cited

U.S. PATENT DOCUMENTS

| | | | |
|---|---|---|---|
| 3,954,087 | 5/1976 | Stevens et al. . | |
| 4,027,145 | 5/1977 | McDonald et al. . | |
| 4,287,430 | 9/1981 | Guido . | |
| 5,675,970 * | 10/1997 | Yamada et al. | 60/670 |
| 5,845,496 * | 12/1998 | Bachmann | 60/646 |

FOREIGN PATENT DOCUMENTS

| | | |
|---|---|---|
| 582 851 | 12/1976 | (CH) . |
| 32 35 557 A1 | 4/1983 | (DE) . |
| 33 04 292 C2 | 7/1987 | (DE) . |
| 44 32 960 C1 | 11/1995 | (DE) . |
| 0 282 172 | 9/1988 | (EP) . |
| 2 381 172 | 9/1978 | (FR) . |

OTHER PUBLICATIONS

"Rechnersiche Simulation des dynamischen Verhaltens eines Kreaftwerksblo ckes nach turbinenschenellschlub" 9Drucks), dated Jan. 1980, VGB Kraftwekstechnik 60, Hert 1, pp. 18–23.

* cited by examiner

*Primary Examiner*—Hoang Nguyen
(74) *Attorney, Agent, or Firm*—Herbert L. Lerner; Laurence A. Greenberg; Werner H. Stemer

(57) ABSTRACT

The object of the invention is to ensure a fast, economical and reliable power regulation of a steam generating power plant (1) having a turbo set that comprises a steam turbine (2) and a generator (6) and during the operation of which water (W) is injected into or upstream of an overheater heating surface According to the disclosed fast power regulating process of the steam generating power plant (1), the injection rate of water (W) is increased to adjust an additional generator output. In a steam generating power plant (1) which is particularly suitable for carrying out the process, an overheater heating surface, of a steam generator (28) is provided with a water injector (70, 71) connected to a regulating component (82) for regulating the injection rate of water (W) into the overheater heating surface. The regulating component (82) supplies a regulating signal to the water injector, (70, 72), depending on the required additional generator output.

14 Claims, 1 Drawing Sheet

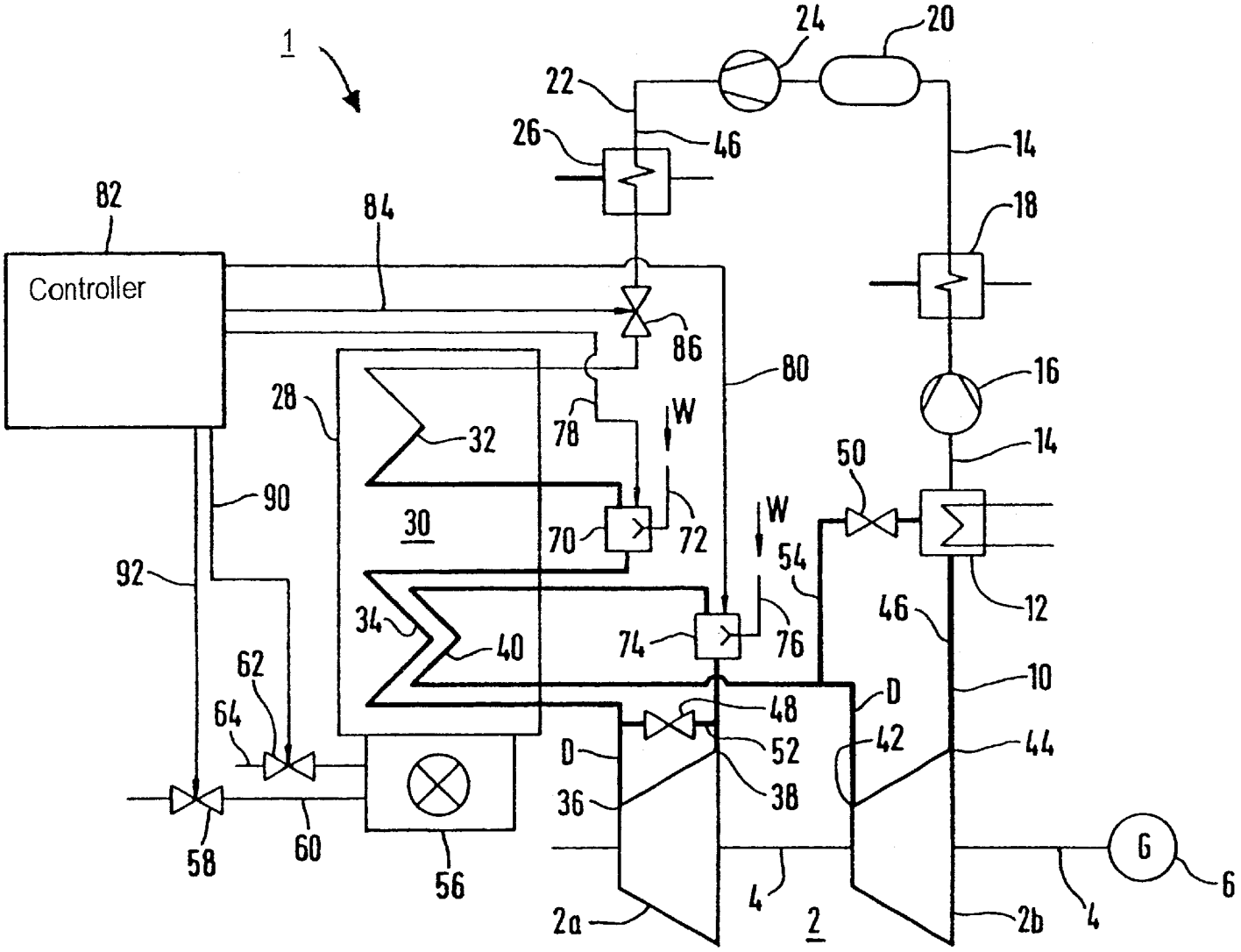
Controller
G
W
W
D
D

METHOD FOR CLOSED-LOOP OUTPUT CONTROL OF A STEAM POWER PLANT, AND STEAM POWER PLANT

CROSS-REFERENCE TO RELATED APPLICATION

This is a continuation of copending international application PCT/DE98/03153, filed Oct. 28, 1998, which designated the United States.

BACKGROUND OF THE INVENTION

FIELD OF THE INVENTION

The invention lies in the field of power generation. The invention relates to a method for closed-loop output control of a steam power plant with a turbo-generator set having a steam turbine and a generator. In operation, the plant water is injected into or upstream of a superheater heating surface. The invention also relates to a steam power plant for carrying out the method.

A closed-loop output control of a steam power plant and such a plant are disclosed, for example, in published French patent application No. 2 381 172.

Reliable power supply in an electric power supply system presupposes careful balancing between the generation of electrical power by a number of power units and the tapping of the electrical power by a number of consumers in an electricity distribution network. If the generation and tapping of the electrical power are equal, the system frequency, which is an important parameter in an electricity network, is constant. The nominal value of the system frequency is, for example, 50 Hz in the European interconnected network. A frequency deviation that occurs, for example, due to the failure of a power unit and to the connection or disconnection of a consumer, can be regarded as a measure of an increase or decrease in the generator output.

Along with the correction of frequency deviations within a power supply system, a further task is maintenance of a prescribed interchange power at coupling points to subnetworks from which the distribution network (interconnected network or separate network) is assembled. One requirement is, therefore, the availability of a fast increase in the output of a power unit within seconds. A possible response reserve requirement, for example, can be a sudden load increase of approximately 3 to 5% (measured with respect to the full load of the power supply system) within 30 seconds. However, the plant disclosed in French application 23 81 172 is neither configured nor suitable for providing such a fast output reserve.

Pages 18 to 23 of the publication "VGB Kraftwerkstechnik", Issue Jan. 1, 1980, describes possibilities for fast closed-loop output control and frequency back-up control. While a plurality of possibilities of intervention exists that can be carried out simultaneously or alternatively for a fast change in output in the range of seconds (seconds reserve), it is also necessary to change the supply of fuel for a permanent change in the output of a power unit. Therefore, for the purpose of bridging delay times within the first seconds in a fossil-fired steam power plant, it is usual for control valves, held in advance in a throttled position of the steam turbine, to be opened and thereby to activate and discharge available steam accumulators virtually without delay. Such an operation mode of the steam power plant in the throttled state leads, however, to a high proper heat consumption, and is, thus, economical only to a qualified extent.

In addition to an increase in output due to the throttling cancellation of control valves of the steam turbine, it is also possible to shut down feed heaters that are provided in the water-steam circuit of the steam turbine and are heated by extraction steam from the steam turbine. A condensate flow guided simultaneously through the low-pressure feed heater can be stopped within a few seconds and increased again. A measure for fast closed-loop output control in fossil-fired power units by shutting down the feed heaters accompanied by stoppage of condensate is also described, for example, in German Patent DE 33 04 292 C2.

It is conventional to use a governing system to subject the fast seconds reserve to closed-loop and/or open-loop control, in other words, to closed-loop control of the loading of steam flows to regenerative feed heaters and/or heating condensers as well as of the process steam and the condensate in the water-steam circuit of the steam turbine of a power unit.

For fast closed-loop output control, that is to say, activating the seconds reserve, the steam supply to the feed heaters is throttled, throttling the process steam and/or throttling the condensate. In such a case, desired setting values for control valves at the turbine bleed points, and for regulating units for setting condensate, are formed to produce a required extra generator output. However, a configuration of a steam turbine suitable for such purpose is disadvantageous because the configuration is relatively complicated. The closed-loop control mechanism is complex and, therefore, vulnerable, resulting in a system that is reliable for fast closed-loop output control only to a qualified extent.

SUMMARY OF THE INVENTION

It is accordingly an object of the invention to provide a method for closed-loop output control of a steam power plant that overcomes the hereinafore-mentioned disadvantages of the heretofore-known devices and methods of this general type and that ensures reliable fast closed-loop output control with a particularly low outlay. In addition, an object is to provide a steam power plant that is particularly suitable for carrying out the method.

With the foregoing and other objects in view, there is provided, in accordance with the invention, a method for closed-loop output control of a steam power plant having a turbo-generator set with a steam turbine, a superheater heating surface and a generator, including injecting plant water into or upstream of a superheater heating surface when the steam power plant is in operation, and setting an extra generator output in a range of approximately 3 to 5% of a full load of the power plant within a reaction time of up to approximately 30 seconds by increasing a water injection rate.

The invention proceeds from the consideration that the expensive activation of steam accumulators in the water-steam circuit of the steam turbine should be dispensed with for reliable fast closed-loop output control in conjunction with a particularly low outlay with regard to the components used. By dispensing with the activation of steam accumulators, it is possible to achieve a relatively fast increase in the output of the steam turbine by a short-term increase in the steam mass flow to be fed to the steam turbine.

Such an increase is performed by additionally injecting water into or upstream of the superheater heating surface.

The additional injection of water into the region of the superheater heating surface has the effect of generating an additional steam flow, which effects an increase in the output of the steam turbine even after a short time. The increase in the water injection rate decreases the steam temperature in the superheater heating surface. The decrease in the steam temperature leads to an increase in the temperature difference between the superheater heating surface and the steam, which is decisive for the level of the heat transfer. As such, accumulator heat can be extracted from the superheater heating surface and, in addition, more heat can be extracted from the flue gas, resulting in a temporary increase of the heat transferred in the steam generator onto the superheater heating surface.

For the purpose of setting the extra generator output, the water injection rate into a high-pressure superheater and/or a reheater is expediently increased.

In order to avoid an undesired decline in the output of the steam turbine, it is expedient that at the latest after a waiting time of approximately one minute, calculated from the increase in the water injection rate, the desired value for the temperature of the steam flowing out from the superheater heating surface is lowered by a prescribable amount. Specifically, it is now understood that the steam temperature in the superheater heating surface drops because of the increased water injection rate after approximately 60 seconds, and, for temperature-controlled closed-loop control, such a drop could lead to a reduction in the water injection rate, and, thus, to a decline in the output of the steam turbine. The drop is reliably avoided given a well-timed reduction in the desired value for the temperature of the steam flowing out from the superheater heating surface.

It is advantageously the case that in parallel with increasing the water injection rate as quickly as possible, that is to say simultaneously with or directly after the increasing of the water injection rate, the fuel supply to a combustion chamber heated by fossil fuel and assigned to the steam generator of the steam power plant is increased by a value matched to the required extra generator output. The increase in the fuel supply can, for example, become effective in the case of a coal-fired steam generator after a time of approximately 2 to 4 minutes in the form of the rise in the electric output of the steam turbine. To the extent that the electric output of the steam turbine rises because of the increase in the fuel supply, the water injection rate can be reduced to its original value, and the closed-loop control of the steam temperature provided for continuous operation can be reactivated.

With the objects of the invention in view, there is also provided a steam power plant receiving water, including a turbo-generator set having a generator and a steam turbine with a water-steam circuit, a controller module, and a steam generator having heating surfaces connected to the water-steam circuit of the steam turbine, the heating surfaces including a superheater heating surface having a water injector connected to the controller for setting a water injection rate into the superheater heating surface, the controller module sending an actuating signal to the water injector for controlling the water injection rate as a function of an extra generator output of approximately 3 to 5% of a full load of the power plant.

Thus, the controller module is configured such that increasing the water injection rate into the superheater heating surface provides an extra generator output required in the short term. The injection valves disposed on the water injector, on which the controller module acts, are expediently provided with quickly operating drives. Moreover, the controller module is configured such that the opening pulse and the closing pulse for the drives of these injection valves are provided by the closed-loop output control of the steam power plant and not by the closed-loop temperature control of the steam power plant.

It is advantageously the case that the controller module is connected on its output side through a signal line to a control valve provided for setting the feedwater supply into the steam generator and/or that the controller module is connected on its output side through a signal line to a control valve provided for setting the fuel supply into a combustion chamber assigned to the steam generator. Thus, the controller module can be used, on one hand, in the short term to activate an output reserve by increasing the water injection rate, and, on the other hand, in the medium or long term, to activate an increase in the continuous output by varying the fuel supply to the combustion chamber.

The advantages achieved with the invention include, in particular, making possible the setting of an extra generator output by increasing the water injection rate in a particularly simple way and without additional requirements being placed on the components used. In particular, there is no need for expensive measures to adapt the steam turbine to the requirements of the fast closed-loop output control. It follows that the concept of fast closed-loop output control is particularly suitable also for steam turbines of typical configuration that can be operated in the entire load range with particularly low heat consumption. In the case of such fast closed-loop output control, the steam turbine is subjected to only a slight load, with the result that even frequent repetition of such fast closed-loop output control does not entail damage to the steam turbine.

Other features that are considered as characteristic for the to invention are set forth in the appended claims.

Although the invention is illustrated and described herein as embodied in method for closed-loop output control of a steam power plant, and a steam power plant, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a diagrammatic representation of the closed-loop output control of a steam power plant according to the invention.

DESCRIPTION OF THE PREFERRED EMBODIMENTS

Referring now to the FIGURE of the drawing in detail, there is to shown a steam power plant 1 having a steam turbine 2 that is connected to a generator 6 through a turbine shaft 4. In the exemplary embodiment, the steam turbine 2 has a high-pressure section 2*a* and a low-pressure section 2*b*. Thus, the steam turbine 2 is a two-stage configuration. Alternatively, the steam turbine 2 can, however, also have only one or have a plurality of pressure stages, in particular, three.

The steam turbine 2 is connected on the output side to a condenser 12 via a steam pipe 10. The condenser 12 is connected through a conduit 14, into which a condensate pump 16 and a steam-heated feed heater 18 are connected, to a feedwater tank 20. The feedwater tank 20 is connected on the output side through a supply conduit 22, into which a feedwater pump 24 and a steam-heated feed heater 26 are connected, to a heating surface configuration 30 disposed in a steam generator 28.

The heating surface configuration 30 includes an evaporator heating surface 32. The evaporator heating surface 32 can be configured as a through-flow evaporator heating surface, or as a natural-circulation evaporator heating surface. To accomplish its purpose, the evaporator heating surface can be connected in a conventional way to a non-illustrated steam-and-water drum for forming a circuit.

The evaporator heating surface 32 is connected to a high-pressure superheater 34, also disposed in the steam generator 28 and which is connected on an output side to the steam inlet 36 of the high-pressure section 2*a* of the steam turbine 2. The steam outlet 38 of the high-pressure section 2*a* of the steam turbine 2 is connected through a reheater 40 to the steam inlet 42 of the low-pressure section 2*b* of the steam turbine 2. Its steam outlet 44 is connected through the steam pipe 10 to the condenser 12, thus producing a closed water-steam circuit 46.

The water-steam circuit 46 represented in the figure is constructed from only two pressure stages. However, the circuit can also be constructed from only one or from a plurality of, in particular, three, pressure stages, with further heating surfaces disposed in a conventional way in the steam generator 28.

Both the high-pressure section 2*a* and the low-pressure section 2*b* of the steam turbine 2 can be bypassed through a bypass conduit 52, 54, respectively, which can be shut off by a valve 48, 50, respectively. The bypass conduit 54 assigned to the low-pressure section 2*b* of the steam turbine 2 opens directly into the condenser 12 on the output side.

The steam generator 28 is assigned a fossil-fired combustion chamber 56. The combustion chamber 56 can be supplied with fuel through a fuel supply line 60, which can be shut off by a valve 58, and can be supplied with combustion air through a conduit 64, which can be shut off by a valve 62.

The high-pressure superheater 34 is assigned a water injector 70 that can be supplied with water W through a supply line 72. The reheater 40 is similarly assigned a water injector 74, which can likewise be supplied with water W through a supply conduit 76. In order to set the water W injection rate into the high-pressure superheater 34 and into the reheater 40, the water injector 70 and the water injector 74 are connected respectively to a controller module 82 through a signal line 78, 80, respectively. In continuous operation of the steam power plant 1, the controller module 82 acts on the water injector 70 and the water injector 74 such that the temperature of the steam D flowing out from the high-pressure superheater 34 or from the reheater 40 is constant in a prescribable tolerance band. To regulate the temperature, the controller module 82 is connected in a non-illustrated way to suitably disposed temperature sensors.

The controller module 82 is configured to make possible, for the purpose of fast closed-loop output control, setting an extra generator output by increasing the water W injection rate into the high-pressure superheater 34 and/or into the reheater 40. To perform fast closed-loop output control, in the case of requiring extra generator output, the temperature-controlled closed-loop control of the controller module 82 is deactivated and replaced by an output-based controller principle. The controller module 82 uses signals, sent to the water injector 70 and the water injector 74, to increase the water W injection rate into the high-pressure superheater 34 or into the reheater 40, such that the output of the steam turbine 2 is increased because of the increased steam mass flows.

On an output side, the controller module 82 is, moreover, connected through a signal line 84 to a control valve 86 connected into the supply conduit 22. Therefore, it is also possible to set the feedwater supply rate to the steam generator 28 through the controller module 82.

Furthermore, the controller module 82 is connected to the valve 62 through a signal line 90, and to the control valve 58 through a signal line 92. Therefore, it is also possible to use the controller module 82 for setting the air supply and the fuel supply to the combustion chamber 56. The controller module 82 is configured such that the fuel supply to the combustion chamber 56 is increased by a value matched to the required extra generator output simultaneously with or directly after the increasing of the water W injection rate.

The steam power plant 1 ensures fast closed-loop output control in a particularly simple way. An extra generator output is possible by increasing the water W injection rate into the high-pressure superheater 34 and/or into the reheater 40.

We claim:

1. A method for closed-loop output control of a steam power plant having a turbo-generator set with a steam turbine, a superheater heating surface and a generator, which comprises:

injecting plant water at a superheater heating surface when the steam power plant is in operation; and setting an extra generator output in a range of approximately 3 to 5% of a full load of the power plant within a reaction time of up to approximately 30 seconds by increasing a water injection rate.

2. The method according to claim 1, wherein the injecting step comprises injecting plant water in the superheater heating surface.

3. The method according to claim 1, wherein the injecting step comprises injecting plant water upstream of the superheater heating surface.

4. The method according to claim 1, wherein the steam power plant includes a high-pressure superheater and the setting step comprises increasing the water injection rate at the high-pressure superheater.

5. The method according to claim 1, wherein the steam power plant includes a reheater and the setting step comprises increasing the water injection rate at the reheater.

6. The method according to claim 1, which comprises, after a waiting time of up to approximately one minute after an increase in the water injection rate, lowering a desired value for temperature of the steam flowing out from the superheater heating surface by a prescribable amount calculated from the increase in the water injection rate.

7. The method according to claim 1, wherein the steam power plant includes a steam generator and a combustion chamber connected to the steam generator and heated by fossil fuel from a fuel supply, and, simultaneously with increasing the water injection rate, increasing the fuel supply to the combustion chamber by a value matched to the extra generator output.

8. The method according to claim 1, wherein the steam power plant includes a steam generator and a combustion chamber connected to the steam generator and heated by fossil fuel from a fuel supply, and, directly after increasing the water injection rate, increasing the fuel supply to the combustion chamber by a value matched to the extra generator output.

9. A steam power plant receiving water, comprising:

a turbo-generator set having a generator and a steam turbine with a water-steam circuit;

a controller; and a steam generator having heating surfaces connected to said water-steam circuit of said steam turbine, said heating surfaces including a superheater heating surface having a water injector connected to said controller for setting a water injection rate into said superheater heating surface, said controller sending an actuating signal to said water injector for controlling said water injection rate as a function of a required extra generator output of approximately 3 to 5% of a full load of the power plant.

10. The steam power plant according to claim 9, wherein said controller prescribes an actuating signal to said water injector for increasing said water injection rate.

11. The steam power plant according to claim 9, including a control valve for setting a feedwater supply into said steam generator, said controller having an output connected to said control valve.

12. The steam power plant according to claim 11, wherein said output of said controller is connected to said control valve through a signal line.

13. The steam power plant according to claim 9, including a combustion chamber connected to said steam generator and a control valve for setting a fuel supply into said combustion chamber, said controller having an output connected to said control valve.

14. The steam power plant according to claim 13, wherein said output of said controller is connected to said control valve through a signal line.

* * * * *